US009218742B2

(12) United States Patent
Barry et al.

(10) Patent No.: US 9,218,742 B2
(45) Date of Patent: Dec. 22, 2015

(54) SYSTEM AND METHOD FOR AIRPORT NOISE MONITORING

(75) Inventors: James Barry, Madison, CT (US); Renee Johns Alter, Stamford, CT (US); Ron Dunsky, Brooklyn, NY (US)

(73) Assignee: PASSUR Aerospace, Inc., Stamford, CT (US)

( * ) Notice: Subject to any disclaimer, the term of this patent is extended or adjusted under 35 U.S.C. 154(b) by 1143 days.

(21) Appl. No.: 11/686,172

(22) Filed: Mar. 14, 2007

(65) Prior Publication Data

US 2007/0217288 A1 Sep. 20, 2007

Related U.S. Application Data

(60) Provisional application No. 60/782,591, filed on Mar. 14, 2006.

(51) Int. Cl.

| | |
|---|---|
| ***G08B 21/00*** | (2006.01) |
| ***G08G 5/00*** | (2006.01) |
| ***G08G 1/01*** | (2006.01) |

(52) U.S. Cl.

CPC ..... *G08G 5/0095* (2013.01); *G08G 1/0104* (2013.01); *G08G 5/0013* (2013.01); *G08G 5/0026* (2013.01); *G08G 5/0082* (2013.01)

(58) Field of Classification Search

CPC .. B64D 45/0015; G01C 23/00; G08G 5/0082; G08G 5/0013; G08G 1/0104; G01S 5/06

USPC ..... 342/456, 454, 455, 465, 457, 463; 701/14, 120, 117, 122; 73/73; 367/136; 340/945, 963, 972, 971

See application file for complete search history.

(56) References Cited

U.S. PATENT DOCUMENTS

| | | | | |
|---|---|---|---|---|
| 6,049,283 | A * | 4/2000 | Lindsay | 340/635 |
| 6,216,066 | B1 * | 4/2001 | Goebel et al. | 701/31.9 |
| 6,408,259 | B1 * | 6/2002 | Goebel et al. | 702/183 |
| 6,885,340 | B2 * | 4/2005 | Smith et al. | 342/465 |
| 6,992,626 | B2 * | 1/2006 | Smith | 342/454 |
| 7,248,219 | B2 * | 7/2007 | Smith et al. | 342/456 |
| 7,383,104 | B2 * | 6/2008 | Ishii et al. | 701/3 |
| 7,437,250 | B2 * | 10/2008 | Breen et al. | 702/34 |
| 2002/0143443 | A1 * | 10/2002 | Betters et al. | 701/29 |
| 2004/0246178 | A1 * | 12/2004 | Smith | 342/454 |
| 2005/0007272 | A1 * | 1/2005 | Smith et al. | 342/189 |
| 2005/0068232 | A1 * | 3/2005 | Smith et al. | 342/465 |
| 2006/0085102 | A1 * | 4/2006 | Doel et al. | 701/14 |
| 2006/0191326 | A1 * | 8/2006 | Smith et al. | 73/73 |
| 2007/0069950 | A1 * | 3/2007 | Smith et al. | 342/456 |
| 2009/0140925 | A1 * | 6/2009 | Smith et al. | 342/454 |
| 2010/0079342 | A1 * | 4/2010 | Smith et al. | 342/451 |

* cited by examiner

*Primary Examiner* — Hoi Lau

(74) *Attorney, Agent, or Firm* — Fay Kaplun & Marcin, LLP

(57) ABSTRACT

Described are a system and a method for airport noise monitoring. The system may include (a) a data receiving arrangement receiving, from a data source, information corresponding to an airport; (b) a data comparing arrangement comparing the received information to noise rules; and (c) an alert generating arrangement generating a noise alert based on the comparison of the received information to the noise rules.

18 Claims, 8 Drawing Sheets

Noise Causality Grid

Report Parameters:
Date: Feb 28 2006
Time Range: 10:00 - 13:00 local
Metrics selected: weather, flow rates, holding patterns

Report Generated:
March 3, 2006

| Time (local) | Configurations | Weather (Actual) | Weather (Forecast) | Arrival Flow Rate | Depart Flow Rate | Holding Pattern(s) |
|---|---|---|---|---|---|---|
| 10:00-Noon | Arr: 16L, 16R, 07<br>Dep: 17R | 1253 WIND from 050 at 7KT<br>TEMP=15C DP=-4C<br>KDEN 031953Z 05007KT<br>10SM FEW080 15/M04<br>A2995 RMK AO2 SLP117<br>T01501044 | 1100->1600 WIND from 360 at 7KT<br>1600->1800 WIND VARIABLE at 5KT<br>1800->2300 WIND from 150 at 9KT<br>2300->0700 WIND from 190 at 12KT<br>0700->1100 WIND VARIABLE at 5KT<br><br>KDEN 031739Z 031818 36007KT<br>P6SM FEW080<br>FM2300 VRB05KT P6SM FEW080<br>FM0100 15009KT P6SM SKC<br>FM0600 19012KT P6SM SCT250<br>FM1400 VRB05KT P6SM | 59 | 68 | 2 |
| Noon-13:00 | Arr: 35L, 35R, 07<br>Dep: 34R | 1353 WIND from 050 at 9KT<br>TEMP=18C DP=-4C<br>KDEN 032053Z 05009KT<br>10SM FEW080 18/M04<br>A2990 RMK AO2 SLP094<br>T01781039 58037 | 1100->1600 WIND from 360 at 7KT<br>1600->1800 WIND VARIABLE at 5KT<br>1800->2300 WIND from 150 at 9KT<br>2300->0700 WIND from 190 at 12KT<br>0700->1100 WIND VARIABLE at 5KT<br><br>KDEN 031739Z 031818 36007KT<br>P6SM FEW080<br>FM2300 VRB05KT P6SM FEW080<br>FM0100 15009KT P6SM SKC<br>FM0600 19012KT P6SM SCT250<br>FM1400 VRB05KT P6SM FEW150<br>SCT200 | 44 | 71 | 0 |

Done Internet

700

Fig. 8

SYSTEM AND METHOD FOR AIRPORT NOISE MONITORING

PRIORITY CLAIM/INCORPORATION BY REFERENCE

This application claims the benefit of U.S. Provisional Patent Application 60/782,591 filed on Mar. 14, 2006 and entitled "System and Method for Airport Monitoring" and is expressly incorporated herein, in its entirety, by reference.

BACKGROUND INFORMATION

Aircraft noise is a major concern for airports, especially those located in heavily populated urban areas. In most cases, as aircraft are taking off and landing, it is virtually impossible to route the aircraft over unpopulated areas. Thus, there is always noise associated with takeoffs and landings. Many airports have noise reporting or complaint departments, e.g., local residents can call and complain when there is an excessive amount of aircraft noise in their area. The noise department will then attempt to mitigate the noise problem. However, the goal of the airports is to not receive noise complaints.

SUMMARY OF THE INVENTION

The present invention relates to a system and a method for airport noise monitoring. The system may include (a) a data receiving arrangement receiving, from a data source, information corresponding to an airport; (b) a data comparing arrangement comparing the received information to noise rules; and (c) an alert generating arrangement generating a noise alert based on the comparison of the received information to the noise rules.]

BRIEF DESCRIPTION OF DRAWINGS

FIG. 8 shows an exemplary web page 700 displaying a noise causality grid including various conditions at the airport according to the present invention.

DETAILED DESCRIPTION

The present invention will now be described with reference to the exemplary embodiments provided in the appended drawings where like elements include the same reference numbers. The exemplary embodiments of the present invention provide an airport noise monitoring system for delivery of information at various times concerning noise factors at an airport. As will be described in detail below, the information may be delivered to the aircraft (e.g., the pilot, the airline, etc.), the airport (e.g., airport noise officer, etc.) or any other interested party such as a governmental regulatory agency. The exemplary embodiments of the present invention allow for the proactive prevention of noise and for the mitigation of noise after a noise event has occurred.

Airport operators have access to many different data sources that include information about the airport, the incoming/outgoing aircraft, the weather, etc. These sources of information may include data received from, for example, an air traffic control (ATC) radar, a passive secondary surveillance radar, a Federal Aviation Administration (FAA) data feed, airline schedule data feeds, a National Weather Service data feed, etc. All this information may be relevant in some manner for the prevention/mitigation of noise for an airport. The exemplary embodiments of the present invention use this information for these purposes. Those skilled in the art will understand that in the following description, exemplary data is described as being useful for carrying out the functionality provided herein. The source of the data is not relevant for the present invention, i.e., the present invention may be implemented regardless of the source of the data. In addition, other data not described herein may serve the same or an equivalent purpose of the data described herein and it is possible for the present invention to be implemented using this alternative data.

Figure 1:
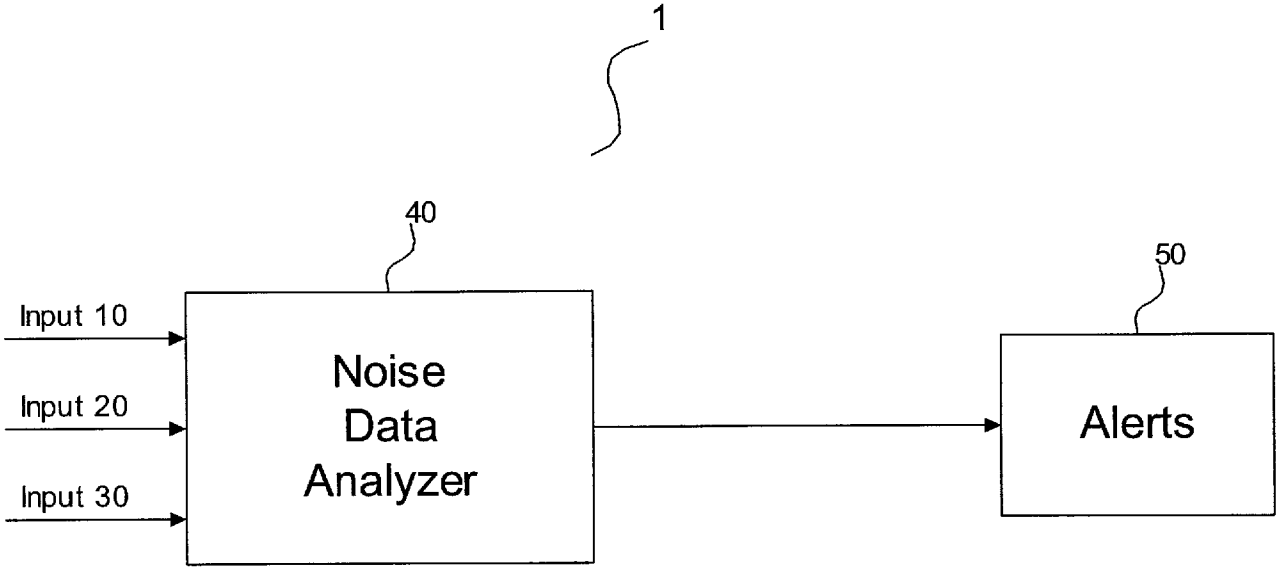
FIG. 1 shows an exemplary noise prevention/mitigation system according to the present invention.

FIG. 1 shows an exemplary noise prevention/mitigation system 1 according to the present invention. The system 1 includes a noise data analyzer component 40 receiving data from three data feeds as input 10, input 20 and input 30. As described above, the inputs 10-30 may be any inputs that relate to data that may be relevant to noise at the airport. Those skilled in the art will understand that the noise data analyzer 40 may receive any number of data inputs and that three inputs is only exemplary. The noise data analyzer 40 receives the data and compares the data to, for example, a set of rules or other standards used for noise monitoring or noise prevention and generates alerts 50 that may be sent to any number of locations as will be described in greater detail below.

In a first exemplary embodiment, the prevention of noise begins prior to a flight taking off from the airport or prior to a flight that takes off from another airport that is destined for the airport. For example, one of the inputs to the noise data analyzer 40 may be airline schedule information indicating each flight that is scheduled to take off from/land at the airport. The noise data analyzer 40 uses this information to generate a flight alert 50 reminder that may be sent to the aircraft or airline. An exemplary reminder alert 50 may be, for example, "We noticed that you have arrived at the Airport X times over the last 6 months. Thanks for continuing to fly quiet." Such a reminder is used to educate pilots in advance, to proactively change the pilot's behavior with respect to the airport's noise regulations/procedures. In this manner, proactive airports may reach out to pilots and flight departments before the flight to educate them, in a positive way, on the airport's noise procedures.

In another pre-flight example, the noise data analyzer 40 receives a filed flight plan as an input. The noise data analyzer 40 compares the filed flight plan to the noise procedure for the airport and may send an alert 50 based on this comparison. For example, if the flight plan violates the noise procedures, an alert 50 that is sent to the aircraft or airline may be, for example, "Flight N1234 will violate our nighttime noise procedures tonight." Thus, the pilot or the airline will know beforehand that a noise procedure will be violated based on the filed flight plan and can make corrections to the flight plan as needed. The alert 50 may also indicate the exact noise procedure that is being violated so that the pilot may make the correct changes to satisfy the noise procedure. In this example, the noise system prevents the noise violation from occurring because it has allowed corrective actions to be taken prior to any violation.

In the above example, it was stated that the noise data analyzer 40 will compare the airport's noise procedures to a type of data. It should be noted that the noise procedures may be input and stored in the noise data analyzer in any known manner. For example, the noise procedures may be a set of rules stored in a database in the noise data analyzer 40 that are used for comparison. The database may be accessible to a system administrator for changing the rules so that each airport may have a unique set of rules. However, those skilled in the art will understand that there be other manner of storing noise procedures and the present invention may implement any of these manners.

In another example of pre-flight notification, the noise data analyzer 40 may receive the filed flight plan, the airline schedule or any other data indicating that a flight is taking off and/or landing at the airport. The noise data analyzer 40 may also store historical data that indicates this flight, this aircraft, this pilot, etc. previously violated a noise procedure based on a previous takeoff/landing from the airport. The noise data analyzer 40 may generate a reminder alert 50 indicating this prior violation so that it does not occur on this flight. The alert 50 may state, for example, "This flight has previously violated the noise procedures at Airport." The alert 50 may also indicate the type of previous violation so that the pilot may avoid the same violation.

In another example, the system 1 may generate alerts during the flight. For example, as an incoming flight is approaching the airport, the noise data analyzer 40 may be receiving data about the flight, e.g., speed, altitude, location, vector, etc. The noise data analyzer 40 may compare this data to the noise procedures to determine if a violation is occurring. For example, it may be a noise violation for an aircraft to be traveling above a predetermined speed when below a predetermined altitude. The noise data analyzer 40 may generate an alert 50 if this situation exists. In this example, the alert 50 may be sent to the pilot for the pilot to take corrective action, but may also be sent to the airport noise officer (or other airport official) so that they are aware an actual violation has occurred.

In another in-flight example, the system 1 may use both real time flight information and historical data to generate alerts 50. For example, in the pre-flight example described above, a repeat offender was provided with a warning alert 50. This repeat offender alert may also be generated in-flight. However, the repeat offender alert may be enhanced based on real time data. For example, the noise data analyzer 40 may include the historical data that indicates a particular flight is a repeat noise offender, but may also include the real time data indicating that the current flight is committing a violation or is near committing a noise violation. An exemplary alert 50 in this case, may be, "Flight N1234 violated noise procedures 6× in the past year and it is 60 miles from the airport." The pilot and/or noise officer may receive this alert 50. This example also shows that the noise procedures may include not only violations (e.g., data values indicating the noise procedure was violated), but may also include warnings (e.g., data values indicating that the noise procedure has not been violated, but is close to being violated).

In another in-flight example, other types of specific data may be used to generate alerts 50. For example, the noise data analyzer 40 may include data that indicates a particular location for a homeowner that makes multiple complaints concerning noise. If a violation occurs over this location, an alert 50 may be generated so that the noise officer may take preventive measures to alleviate any problems with the homeowner. An exemplary alert 50 in this situation may be "A G2 regional jet just flew over Mr. Jones' house. In the past month, Mr. Jones has complained frequently about G2 flights in this area. We estimate that the noise level from that operation was 79 dBA. Click here to see how that compares with other community noise." Thus, the noise officer has received an alert 50 indicating a potential problem and has received data that may allow the noise officer to effectively address any concerns that homeowner may have.

The above example also shows that the noise data analyzer 40 may use the input data 10-30 to generate additional noise data that may be included in the alerts. As shown above, the noise data analyzer 40 provided a decibel level associated with the noise violation and/or incident. The noise data analyzer 40 may include formulas, tables, etc. that are used to generate this additional noise data used in the alerts 50.

The system 1 may also be used shortly after flight arrivals. For example, an airport may have a curfew that does not allow flights to arrive during a certain time period. Immediately after this time period expires, an alert may be generated showing those flights that violated the curfew. An exemplary alert 50 may be "The following flights arrived between 2400 and 0600 last night: 6. Click on the following link to see a detailed report of the violators."

Another after-flight example may include flight path deviations being detected by the noise data analyzer 40. An exemplary alert 50 may be "you asked to be notified if arrival flight paths for DEN changed by more than 5 miles over a 2 week period for more than 15 flights. We have detected that the flight paths of 17 aircraft have deviated more than 5 miles over the past 2 weeks. Click here to see a list of the flights."

Continuing with another example, an airport may experience unusual operation due to, for example, weather or other irregular operating circumstance. The system 1 may generate a series of alerts that shows the noise conditions and/or violations during the irregular operation and may also provide the irregular operation so that the noise officer is aware as to the reason for a set of violations. For example, an alert 50 of the following type may be generated by the noise data analyzer 40. "Last week we had an unusual day with operations on runway 9R. We estimate the DNL (decibel noise level) for that day was 64 dBA at Location A, compared to their usual DNL of 56 dBA. Click here to view annual and daily contours." Thus, in this example, the noise data analyzer 40 includes data that indicates the noise violations, but it also included data that indicated a specific reason for the violations (e.g., an unusual operation). The noise data analyzer 40 may receive an input indicating the unusual activity or it may detect the unusual activity based on a set of rules (e.g., runway 9R is only used under certain conditions) or it may detect the unusual activity based on historical data (e.g., runway 9R has never been used under the particular operating conditions of the airport such as weather, etc.).

These exemplary alerts may be used to educate pilots either before the flight has taken off, while in-flight or upon landing, to change their behavior in order to obey the airport's noise procedures. The exemplary embodiments allow airports to be proactive in reaching out to pilots to remind them of the best procedures to minimize noise. These exemplary alerts also allow for the responsible airport official (e.g., noise officer) to instantly analyze noise events in a way that allows them to easily isolate the key causes, and communicate those in relevant and effective reports to the ATC, community leaders, and in legal settings. Moreover, if the airport chooses to do so, it can make any of the alerts described herein available to, for example, community groups or local governmental agencies to show good faith in monitoring noise conditions. Thus, these groups along with the airport will have the information to make any needed changes to the airport to deal with noise conditions.

In addition to specific flight information that was described using the above examples, the system 1 may also be used to determine trends that occur with respect to the noise conditions of an airport. For example, flight path information may impact noise conditions. In one example, as a flight path is moved, it may impact a different neighborhood or may move from a relatively lightly populated are to a more densely populated area. This information may impact the noise conditions at an airport or may impact the complaints that the airport receives.

In one example, the noise data analyzer 40 may keep historical data regarding flight paths (e.g. based on flight track information received by the noise data analyzer 40). If a flight path changes, the noise data analyzer 40 may generate an alert 50 such as "You asked to be notified if the flight paths for the Airport changed in any one direction by more than 5 miles over a 3 month period. We have detected that the flight paths for the Airport has changed by more than 10 miles in the last 3 months. Click on the following to see detailed flight tracks and information." In this example, the noise officer 50 may receive additional data such as the historical trends in flight tracks. The noise officer is now aware that there has been a change and may evaluate how that change effects the noise conditions at the airport.

Other trend data that may be useful for determining impacts on noise conditions include the type of aircrafts that are landing at an airport. For example, a particular type of aircraft may be known to be louder than other aircraft and the noise officer may desire to know if there has been an increase in this type of traffic at the airport. The noise data analyzer 40 may receive the aircraft type data as an input and may keep historical records. The noise data analyzer 40 may then generate an alert 50 based on a trending rule established by the noise officer. An alert 50 of this type may be "You asked to be notified if the aircraft type for the Airport changed by 10% for any particular aircraft type over any 3 month period. We detected that the Airport has a 20% increase in the following types of aircraft G-2, LR 24, LR 25 over the last 3 months. Click on the following to see a detailed report."

The noise officer may then use this alert data to take proactive steps to prevent further noise complaints. For example, the noise officer may request that airlines do not use these aircraft types as often at the airport. This alert data may also indicate to the noise officer as to why there have been additional noise complaints. Again, the alert data may also help the noise office to deal with any complaints.

In another trending example, noise complaints may rise in the nighttime because more people are at home and are more likely to notice any aircraft noise. Thus, it may be valuable to understand if there are any deviations in nighttime operations at the airport. In one example, the noise data analyzer 40 may generate an alert of the following type: "You asked to be notified if the number of night operations increase by 10% over your baseline over any 3 month period. We detected that the number of night operations increased by 10% in the last 3 months. Click on the following to see a detailed report."

In another trending example, noise conditions at an airport may be significantly affected by the runway usage. For example, an approach to one runway, may be over water resulting in very few noise complaints and very few noise violations because the noise rules may be less stringent for this approach. Whereas, the use of another runway result in more stringent noise procedures because of the approach being over a heavily populated area. The noise data analyzer 40 may monitor runway usage and generate alerts 50 of the following type: "You asked to be notified if we identified any significant changes in runway usage for 4R at the Airport. We've identified that runway 4R has received 25% more flights over the last 3 months than the norm. Click on the following to see a detailed report."

In a final trending example, the noise data analyzer 40 may use multiple types of information to provide alerts 50. In this example, runway usage data and weather data is used to generate an alert of the following type: "You asked to be notified when there's a noticeable change in runway configurations during normal weather conditions. We've noticed that over the last 3 months, the Airport runway configurations have changed over 30% where this configuration is usually reserved for irregular weather operations. Click on the following to see a detailed report."

Thus, the above described trending examples may be used to proactively address any noise issues that may arise from trending changes at the airport. These trending alerts may be used to inform and collaborate to make changes to the airport so that noise violations do not increase or to address concerns based on the trending changes. This information may be used to educate ATC, carriers, general aviation operators and the public about noise conditions and procedures at the airport.

Those skilled in the art will understand that the above examples provide for automatically alerting the Noise Officer (or other responsible party) of changes in trends or unusual events in real-time so that they are never surprised and/or a corrective action to reduce noise may be immediately implemented. In the above examples, the type of data needed to implement the example was provided (e.g., flight schedules, flight tracks, weather data, etc.). As described above, these are only exemplary and other data may be used to accomplish the same or a similar function. In other examples, the exact data used was not specifically stated. For example, it was stated that runway configuration data was used in some trending examples. Those skilled in the art will understand that any data that shows runway configurations may be used to implement this example. For example, in one exemplary embodiment, passive secondary surveillance radar data may be used to provide location and altitude data. If the aircraft has a zero altitude and its location corresponds with the location of a runway, it may be determined that the aircraft has landed on that runway. However, there may also be other manners of determining a runway configuration.

Figure 2:
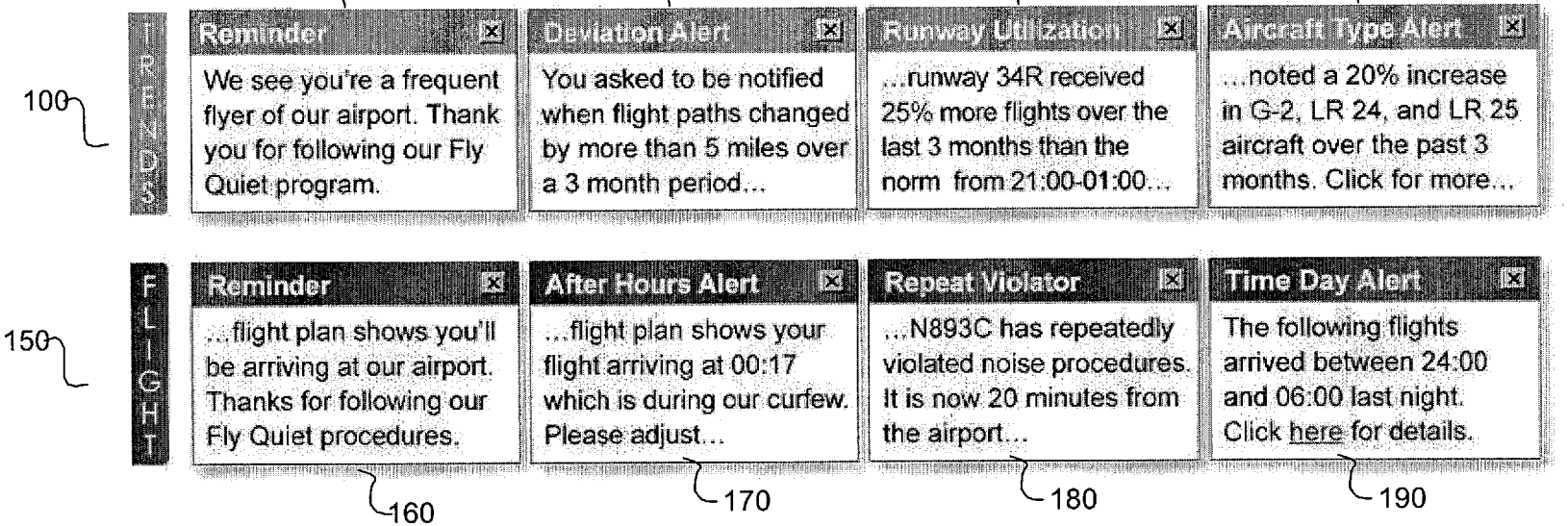
FIG. 2 shows additional exemplary noise alerts that may be generated by the exemplary system according to the present invention.

FIG. 2 shows additional exemplary noise alerts that may be generated by the system. In this example, a set of trend noise alerts 100 and a set of flight noise alerts 150 are shown. The trend noise alerts 100 include a reminder noise alert 110, a deviation alert 120, a runway utilization report 130 and an aircraft type alert. As described above, these trend noise alerts 100 are based on trending data that may be collected over a period of time such as a day, a week, a month, several months, etc. The noise data analyzer may store this trending data and compare the trends to trend noise alert rules that are defined by, for example, the noise officer. When a trend meets the condition(s) set forth in the rule, the correct alert 110-140 is generated.

The flight noise alerts 150 include a reminder noise alert 160, an after hours noise alert 170, a repeat violator noise alert 180 and a time of day noise alert 180. In contrast to the trend alerts, the flight alerts are based on a particular flight that is departing from/arriving at the airport. While in some situations, this may include the use of historical information (e.g., repeat violator alerts), this historical data is still for the particular flight and not a general trend at the airport.

The noise data analyzer 40 may be included as a software application in a computing device such as a server. The server may execute lines of software code to produce the functionality described above for the noise data analyzer. The server may also include other functionality such as a web server or other data distribution method. For example, the server may host a web page that includes the alerts such that when a user (e.g., the noise officer) accesses the web page, the user may see any alerts that are directed at the user. Those skilled in the art will understand that the web server and the noise data analyzer 40 do not need to reside on the same physical hardware server.

Figure 3:
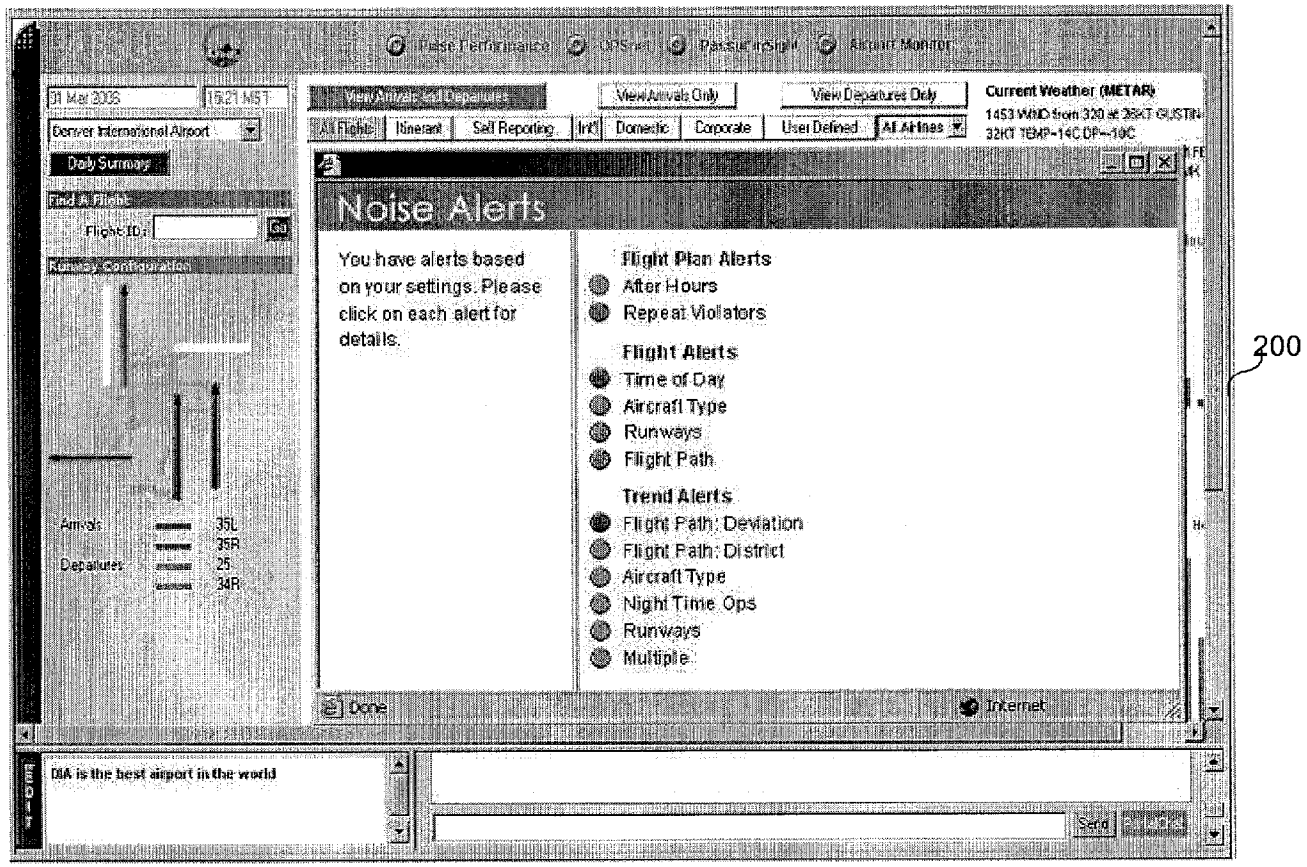
FIG. 3 shows an exemplary web page for displaying noise alerts according to the present invention.

FIG. 3 shows an exemplary web page 200 for displaying noise alerts. In this example, when the user accesses the web server, the web page 200 is displayed. The web page 200 shows the user the types of alerts that are available for the user. In this example, there are three general categories of noise alerts, Flight Plan Alerts, Flight Alerts and Trend Alerts. While not shown in this figure, the circle in front of the different alert types may be color coded to indicate whether an alert is available. For example, if there is no alert, the circle may be coded green, while if there is an alert the circle may be coded red. If an alert is particularly urgent, the circle may be a blinking red. Those skilled in the art will understand that web page 200 is only exemplary and there are any number of manners of showing alerts to users.

Figure 4:
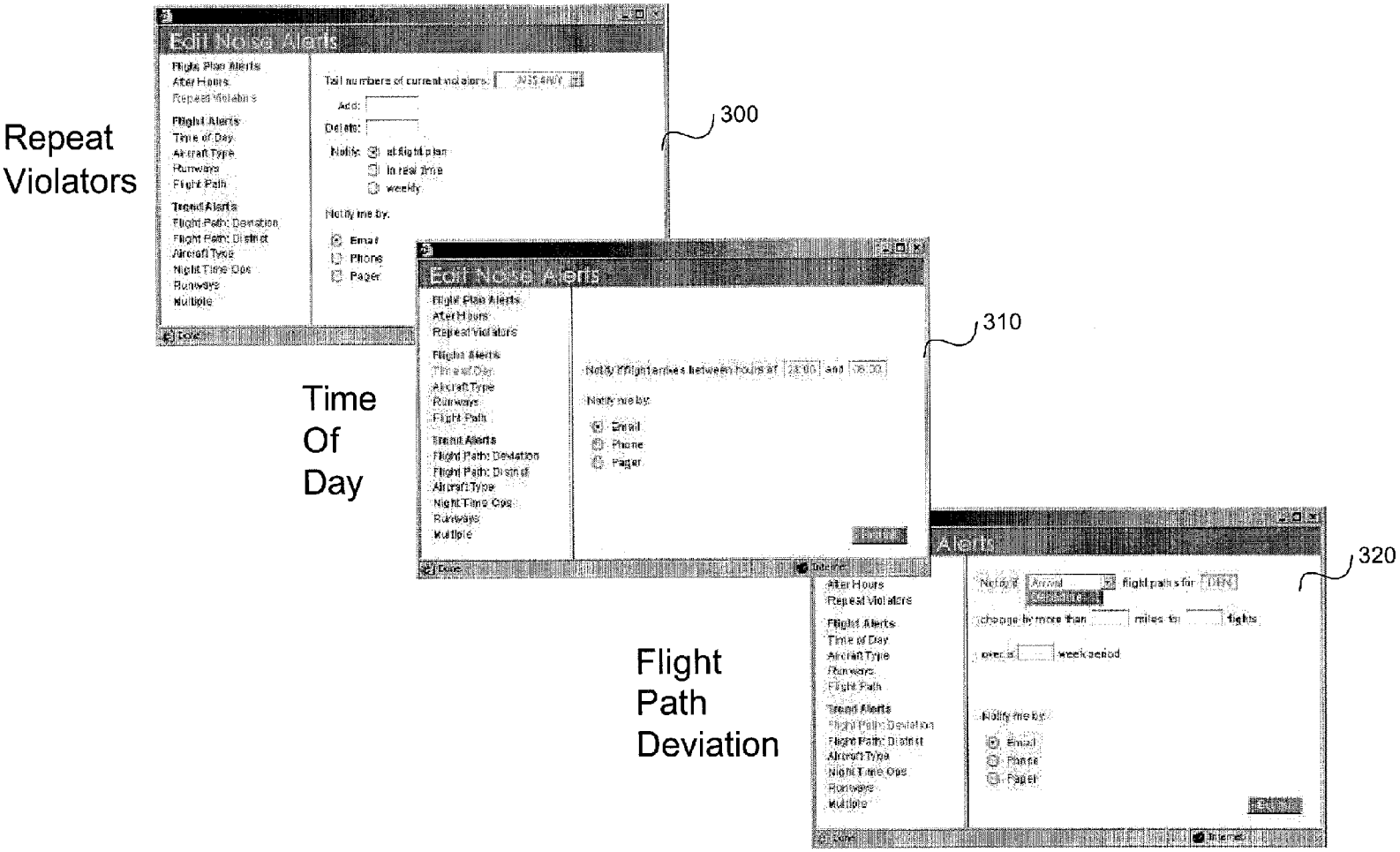
FIG. 4 shows examples of web pages that may be used to edit noise rules or procedures to generate alerts according to the present invention.

FIG. 4 shows examples of web pages 300-320 that may be used to edit noise rules or procedures to generate alerts. Each of the exemplary web pages 300-320 includes a tab bar on the left side to select the particular category or type of alert that may be selected for editing. In the example of web page 300, the repeat violator alert rules are being edited. As shown by this example, an aircraft (identified by tail number) has been identified as a repeat violator. Thus, the user desires to generate repeat violator alerts for this aircraft by adding this aircraft to the repeat violator alerts. The web page 300 may also be used to delete the aircraft from the repeat violator alerts. The user may select when the alert should be generated (e.g., at flight plan, in real time (such as in-flight) or weekly). The user may also select how the alert should be sent such as by email, by phone or by pager. As described above with reference to FIG. 3, the user may display alerts using the web page 200. However, as will be described in greater detail below, the alerts may be sent to the user in other manners.

The web page 310 shows an example for editing for time of day alerts that is a Flight Alert. The web page 320 shows an example for editing a flight path deviation that is a trend alert. Thus, when a user makes changes via the web pages 300-320, the changes to the alert rules or procedures are stored by the noise data analyzer 40, so that the incoming data may be analyzed against the current rules. Thus, the exemplary embodiments allow each individual having access to the system to set their own alert triggers. Also, while not shown in this example, the user may also select who receives these alerts. For example, the user may select themselves, the pilot, the airline, a community member, the ATC, etc., or any combination thereof. Thus, even those individuals not having direct access to the noise system may be defined by an authorized user to receive selected alerts.

Figure 5:
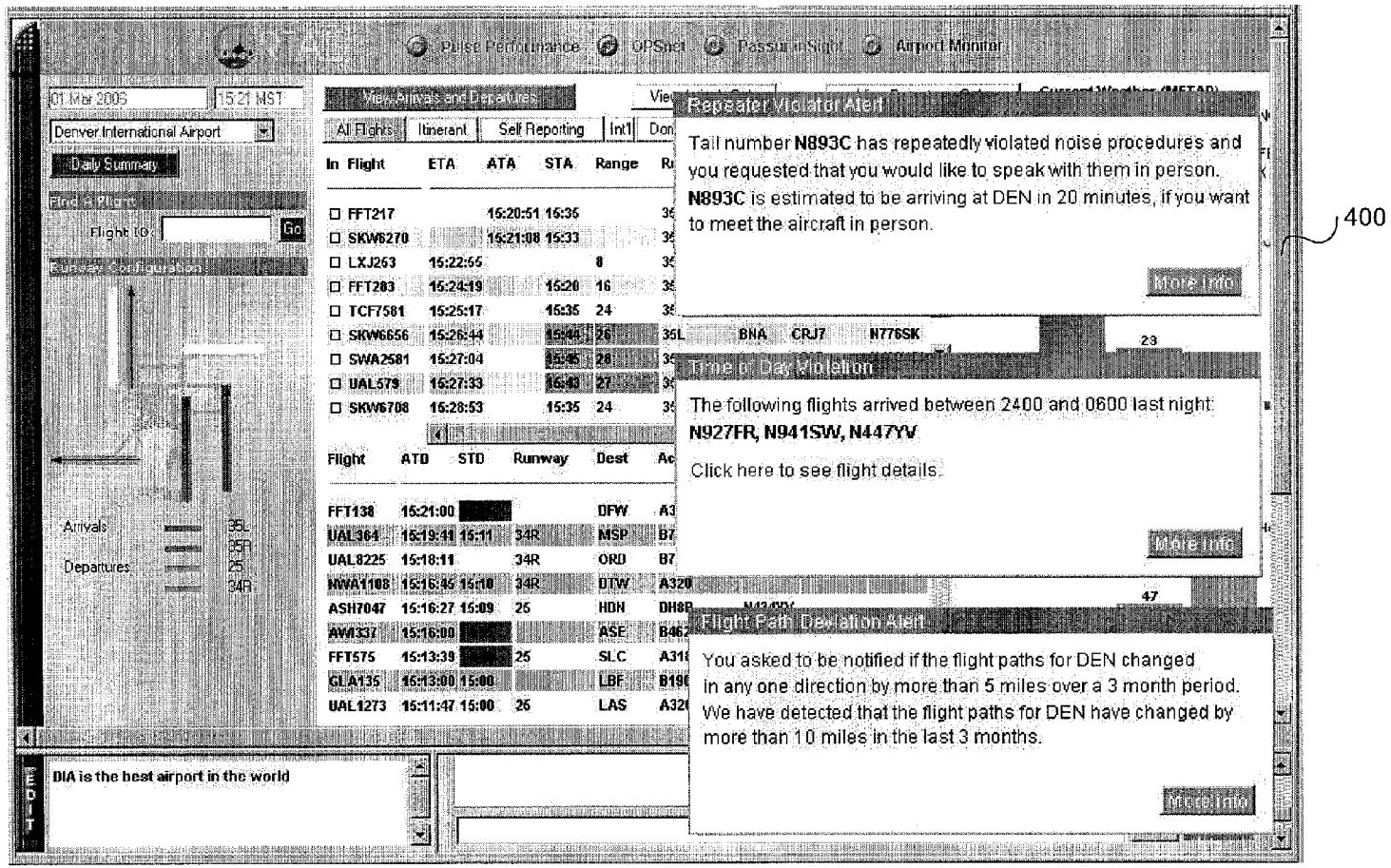
FIG. 5 shows an exemplary web page that shows noise alerts and back up data for the noise alerts according to the present invention.

FIG. 5 shows an exemplary web page 400 that shows noise alerts and back up data for the noise alerts. As shown on web page 400, three alerts are being displayed to the user, a repeat violator alert, a time of day alert and a flight path alert. As shown in the background of web page 400, flight data is also being displayed to the user. Thus, the user has configured this system to provide alerts as pop-up windows above the displayed flight data. However, those skilled in the art will understand that other methods of configuring the display of alerts may also be used. In each case, the alert also includes the option of receiving additional information for the alert. If the user selects to receive additional information for the alert, the flight data (or other data) corresponding to the alert may be shown to the user via, for example, an additional pop-up box.

Figure 6:
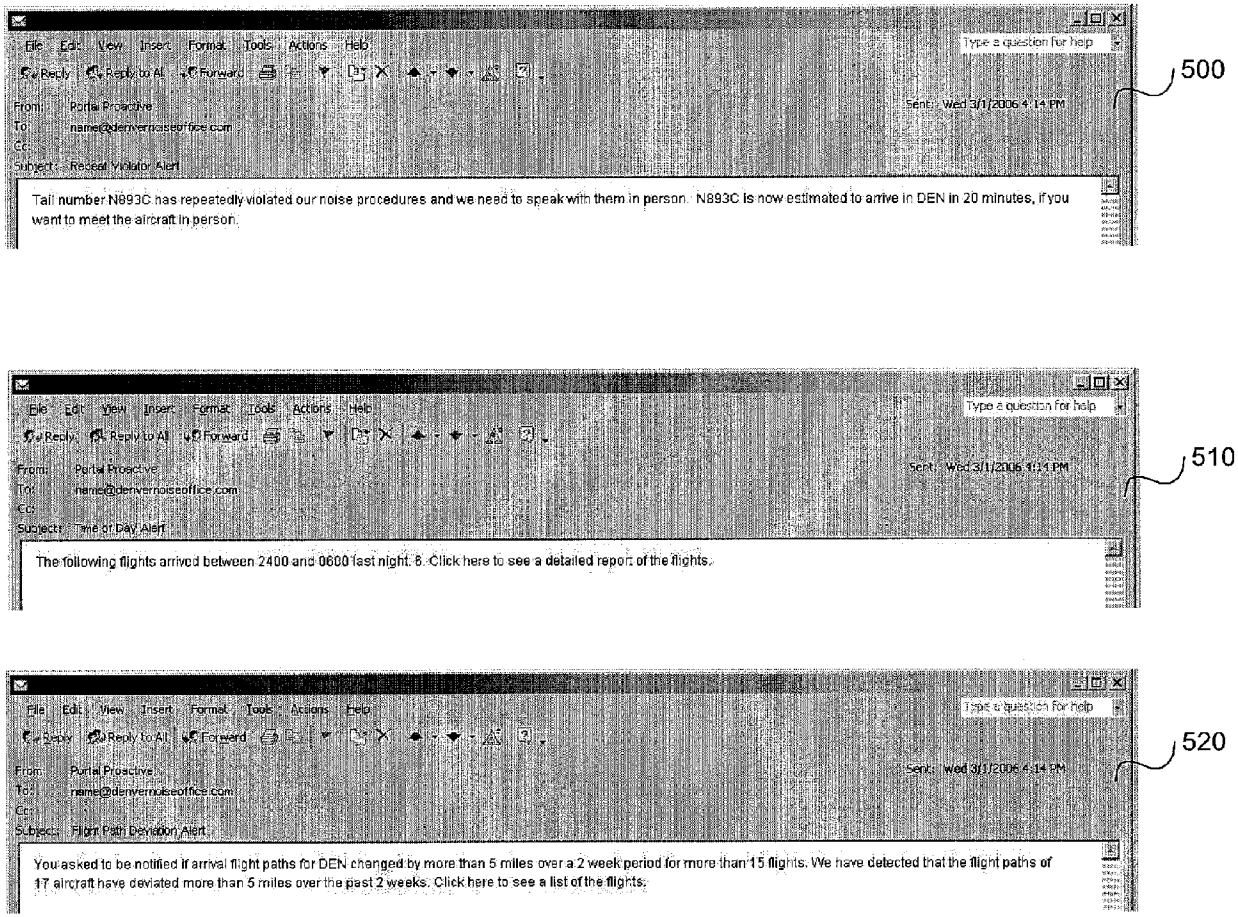
FIG. 6 shows three exemplary noise alerts that are communicated to the user via email according to the present invention.

FIG. 6 shows three exemplary noise alerts 500-520 that are communicated to the user via email. As described above, the user may configure the noise system to alert the user in any number of manners. In one exemplary embodiment, the server may also include an email program (e.g., Outlook, Lotus Notes, etc.) that allows the server to create and send emails. When an alert is generated by the noise data analyzer 40, the server may generate an email based on the rules input by the user. The email alert may then be sent to the email address in the configuration information for the alert. FIG. 6 shows a repeat violator email alert 500, a time of day email alert 510 and a flight path deviation email alert 520.

Figure 7:
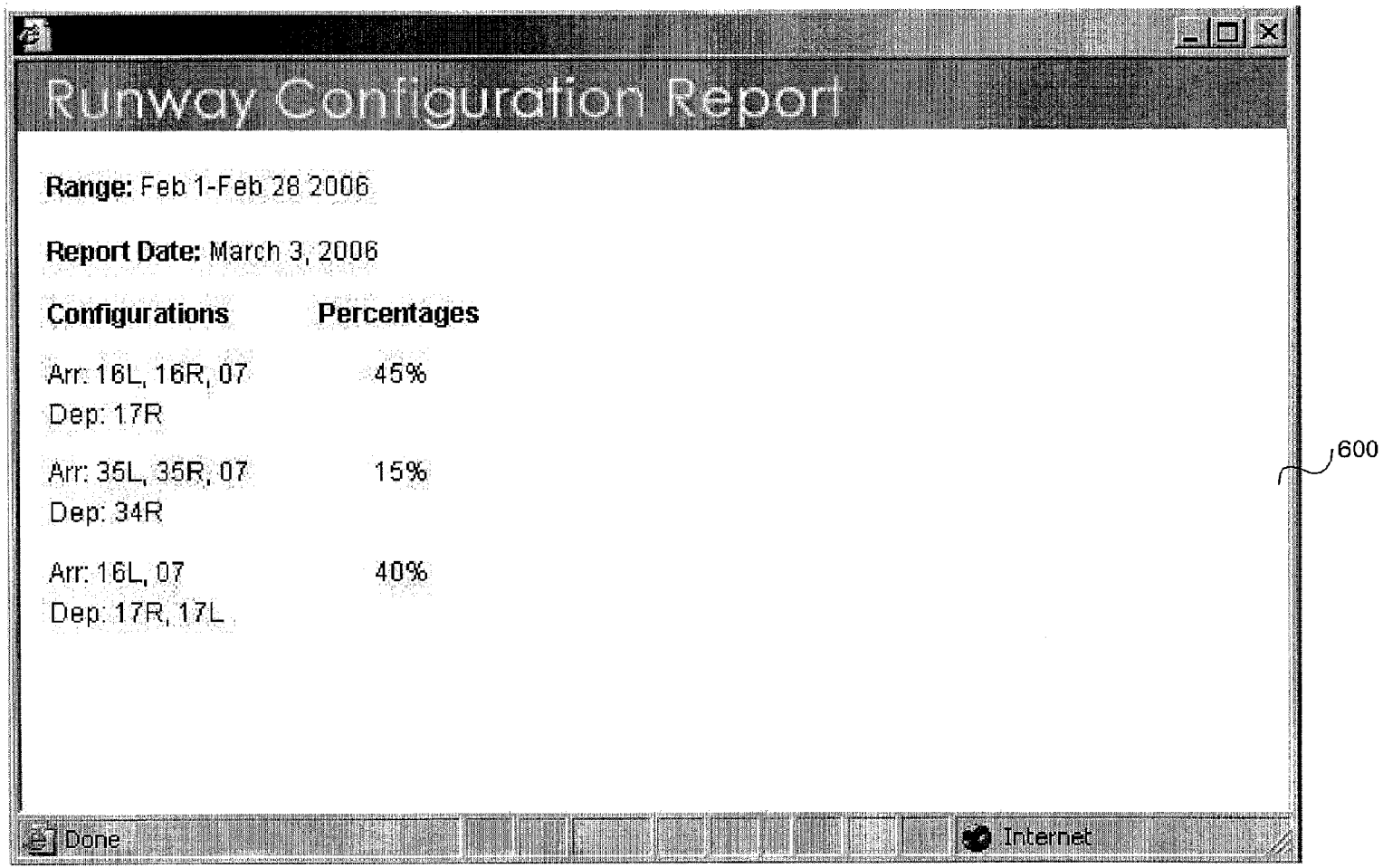
FIG. 7 shows an exemplary web page displaying an exemplary runway configuration report according to the present invention.

FIG. 7 shows an exemplary web page 600 displaying an exemplary runway configuration report. As described above, the runway configuration may have a significant effect on the noise conditions at an airport. Thus, the data concerning the runway configuration may be important for the noise officer. Therefore, web page 600 shows an exemplary display of runway usage for a defined time period. The user and/or the noise system may use this data to correlate to complaints or noise violations to determine the effect of runway configurations on the noise conditions.

FIG. 8 shows an exemplary web page 700 displaying a noise causality grid including various conditions at the airport. In this example, the grid shows selected data including a time range, the runway configuration, the actual weather, the forecasted weather, the flow rates and the holding patterns. Those skilled in the art will understand that the web page 700 may be configured to display any type of data. However, in this case, the user has selected the exemplary data. The user may use this data to correlate to complaints or noise violations to determine the effect of this data on the noise conditions.

In the preceding specification, the present invention has been described with reference to specific exemplary embodiments thereof. It will, however, be evident that various modifications and changes may be made thereunto without departing from the broadest spirit and scope of the present invention as set forth in the claims that follow. The specification and drawings are accordingly to be regarded in an illustrative rather than restrictive sense.

What is claimed is:

1. A system, comprising:

a data receiving arrangement receiving, from at least one data source, flight information corresponding to an airport, historical flight data, and real time flight data;

a data comparing arrangement comparing the received information to modifiable noise rules; and an alert generating arrangement generating a noise alert prior to a noise violation based on the comparison of the received information to the noise rules, wherein the noise alert is a trend alert indicating at least one of the following trends, including airport usage frequency, flight path deviation trends, trending aircraft type, trends in timing of airport operations, trending runway usage, and trending weather conditions for runway usage.

2. The system of claim 1, further comprising:

a web server distributing the noise alert.

3. The system of claim 1, further comprising:

an electronic mail application distributing the noise alert via an electronic mail.

4. The system of claim 1, wherein the noise alert further includes a flight alert.

5. The system of claim 1, wherein the received flight information includes at least one of a flight plan, airline schedule, runway configurations, weather conditions, airport operating conditions, prior violations, and prior noise complaints.

6. The system of claim 4, wherein the flight alert is generated one of before the flight takes off, while the flight is in-route and after the flight has landed.

7. The system of claim 1, further comprising:

a user interface receiving the noise rules.

8. A method, comprising:

receiving flight information corresponding to an airport, historical flight data, and real time flight data;

comparing the flight information to modifiable noise rules for the airport; and generating a noise alert prior to a noise violation based on the comparison of the flight information to the noise rules, wherein the noise alert is a trend alert indicating at least one of the following trends, including airport usage frequency, flight path deviation trends, trending aircraft type, trends in timing of airport operations, trending runway usage, and trending weather conditions for runway usage.

9. The method of claim 8, further comprising:

distributing the noise alert.

10. The method of claim 9, wherein the distributing of the noise alert is via one of a web page, an electronic mail and a phone call.

11. The method of claim 8, wherein the noise alert further includes a flight alert.

12. The method of claim 8, wherein the received flight information includes at least one of a flight plan, airline schedule, runway configurations, weather conditions, airport operating conditions, prior violations, and prior noise complaints.

13. The method of claim 11, wherein the flight alert is generated one of before the flight takes off, while the flight is in-route and after the flight has landed.

14. The method of claim 8, further comprising:

receiving the noise rules.

15. A system comprising a memory storing a set of instructions and a processor for executing the instructions, the set of instructions being operable to:

receive flight information corresponding to an airport, historical flight data, and real time flight data;

compare the flight information to modifiable noise rules for the airport; and generate a noise alert prior to a noise violation based on the comparison of the flight information to the noise rules, wherein the noise alert is a trend alert indicating at least one of the following trends, including airport usage frequency, flight path deviation trends, trending aircraft type, trends in timing of airport operations, trending runway usage, and trending weather conditions for runway usage.

16. The system of claim 1, wherein the trend alert is based on the historical flight data.

17. The method of claim 8, wherein the trend alert is based on the historical flight data.

18. The system of claim 15, wherein the trend alert is based on the historical flight data.

* * * * *